US007917359B2

(12) United States Patent
Morito

(10) Patent No.: US 7,917,359 B2
(45) Date of Patent: Mar. 29, 2011

(54) NOISE SUPPRESSOR FOR REMOVING IRREGULAR NOISE

(75) Inventor: Makoto Morito, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 971 days.

(21) Appl. No.: 11/806,316

(22) Filed: May 31, 2007

(65) Prior Publication Data

US 2008/0052067 A1 Feb. 28, 2008

(30) Foreign Application Priority Data

Aug. 25, 2006 (JP) ..... 2006-229341

(51) Int. Cl.
*G10L 21/02* (2006.01)

(52) U.S. Cl. ..... 704/226

(58) Field of Classification Search ..... 704/226–228
See application file for complete search history.

(56) References Cited

U.S. PATENT DOCUMENTS 6,138,093 A * 10/2000 Ekudden et al. ..... 704/228
7,120,579 B1 * 10/2006 Licht ..... 704/225
2005/0288923 A1 12/2005 Kok

OTHER PUBLICATIONS

S. F. Boll, et al., "Suppression of Acoustic Noise in Speech Using Spectral Subtraction", IEEE Trans., vol. ASSP-27, No. 2, Apr. 1979.
B. Widrow, et al., "Adaptive Noise Cancelling: Principles and Applications", IEEE Proc., vol. 63, No. 12, Dec. 1975, pp. 1692-1716.

* cited by examiner

*Primary Examiner* — Angela A Armstrong
(74) *Attorney, Agent, or Firm* — Rabin & Berdo, P.C.

(57) ABSTRACT

A noise suppressor detects a peak position in the frequency spectrum of an input speech signal, and masks frequency components in the spectrum as a function of the peak position. The masking process attenuates or removes frequency components near the peak position if their magnitudes are significantly lower than the magnitude of the spectrum at the peak position. This noise suppressor effectively removes irregular noise from the spectrum while leaving enough of the spectrum to reproduce the speech signal clearly.

11 Claims, 4 Drawing Sheets

NOISE SUPPRESSOR FOR REMOVING IRREGULAR NOISE

BACKGROUND OF THE INVENTION

1. Field of the Invention

The present invention relates to a noise suppressor for removing noise from an audio signal.

2. Description of the Related Art

Fixed and mobile telephone sets are often used for input of speech. Frequently the input includes noise, such as noise at a traffic intersection or in an office, that makes the speech difficult to understand and may cause automatic voice recognition facilities to operate incorrectly. The input signal must accordingly be processed to remove the noise. Various methods have been proposed.

One of these is the SPAC method proposed by Takasugi et al. in "Jikosokankansu wo riyo shita onsei shori hoshiki (SPAC) no kino to kihon tokusei" (Processing of SPAC (Speech Processing system by use of AutoCorrelation function) and fundamental characteristics), IECE of Japan, J62-A, No. 3, pp. 175-182, March 1979. The autocorrelation function $\psi$ of a periodic wave has the same frequency components as the original signal and its periodicity is easy to detect. The amplitude components of the autocorrelation function $\psi$ of random noise, however, are concentrated around the origin. The SPAC method uses these differing autocorrelation properties by taking the waveform of a short-term autocorrelation function of the speech signal and splicing it to reproduce the speech signal. This reduces the noise level and improves the signal-to-noise ratio. When applied to a quantized signal, the SPAC method greatly reduces the noise level during pauses, making for much more pleasant listening.

The SPAC method, however, requires extensive computation to derive the autocorrelation function. Another problem is that the autocorrelation process squares the amplitudes of the frequency components, thereby distorting the reproduced speech signal. The distortion can be reduced by an equalization process that decomposes the input signal into several frequency bands and divides the signal in each frequency band by its mean square root, but this is also computationally expensive, and some distortion still remains.

Another known noise reduction method is to store the spectrum of noise averaged over intervals in which speech is absent, and subtract this noise spectrum from the spectrum of the speech signal in intervals in which speech is present, as described by Boll in "Suppression of acoustic noise in speech using spectral subtraction", IEEE Trans. ASSP-27, No. 2, pp. 113-120, 1979. This method, however, rests on the assumption that the ambient noise maintains a steady state. Spectral subtraction is effective in removing regularly occurring noise and small noise components, but it fails in an environment in which the noise level is high and the noise is irregular.

Another known method of reducing noise is to compare signals picked up by two microphones, one of which receives the intended speech signal and ambient noise while the other receives only the ambient noise, but besides requiring an extra microphone, this method requires extensive processing and is impractical in devices that do not provide a suitable location for mounting the second microphone.

There is a need for a single-microphone noise suppression method that does not require extensive computation or other processing.

SUMMARY OF THE INVENTION

An object of the present invention is to provide a noise suppressor that effectively removes irregular noise components without requiring extensive computation.

A noise suppressor according to the present invention comprises a peak detector and a masking processor. The peak detector detects positions of peaks in the frequency spectrum of an input speech signal. For each detected peak position, the masking processor reduces components of the spectrum as a function the peak position, thereby generating a noise-suppressed spectrum. One type of masking operation removes or attenuates frequency components with magnitudes significantly smaller than the magnitude of a nearby peak value. The criteria for being nearby and significantly smaller are defined by a masking function, and may vary depending on the position and magnitude of the peak.

The noise suppressor may also include an analyzer that obtains the frequency spectrum of the input speech signal, and a signal generating processor that converts the noise-suppressed spectrum to an output speech signal.

Irregular noise components are effectively removed because such components do not generate peaks in the frequency spectrum and can be suppressed by reducing spectral components that are not associated with the peaks.

Extensive computation is not required because the masking function can be prestored in a memory and applied without any computation at all.

DETAILED DESCRIPTION OF THE INVENTION

Figure 1:
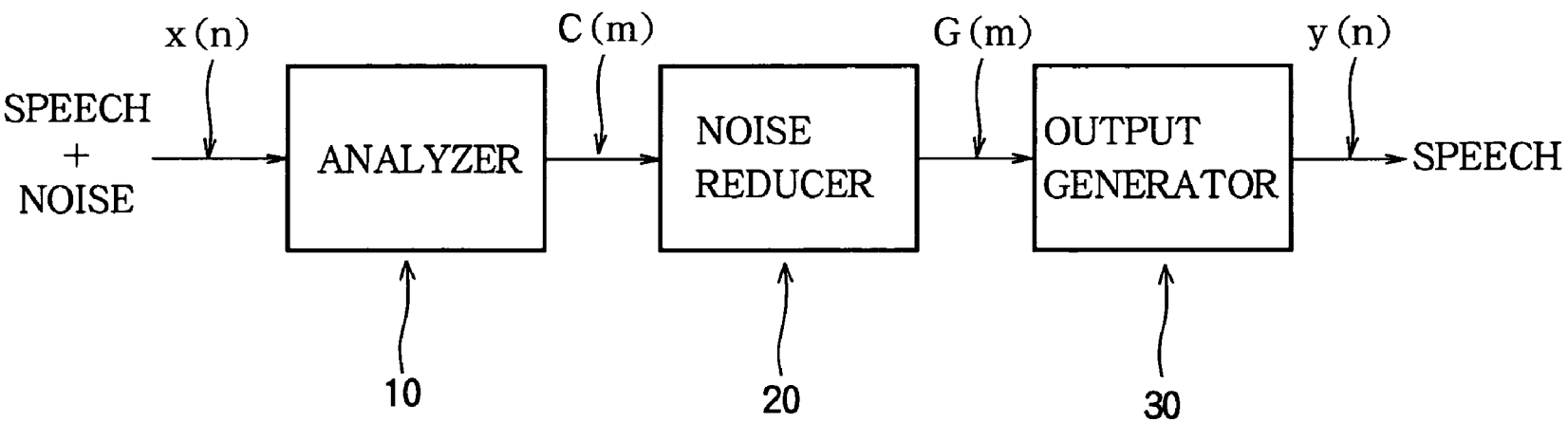
FIG. 1 is a block diagram showing the general structure of a noise suppressor according to an embodiment of the invention.

A noise suppressor embodying the invention will now be described with reference to the attached drawings, in which like elements are indicated by like reference characters. This noise suppressor may be used as a preprocessor in speech recognition apparatus, or as an initial stage for processing a speech signal picked up by a microphone in a mobile telephone or hands-free telephone, although the embodiment is not restricted to these applications.

Referring to FIG. 1, the main components of the noise suppressor 1 are an analyzer 10, a noise reducer 20, and an output generator 30. These components may be implemented as specialized hardware, or as software executed by a central processing unit (CPU) in a computing device.

The analyzer 10 receives a digital speech signal x(n) including noise, and executes a fast Fourier transform (FFT) to analyze the signal into a complex-valued frequency spectrum C(m). The noise reducer 20 receives the frequency spectrum output from the analyzer 10 and removes noise components. The output generator 30 then generates an output speech signal y(n) by performing an inverse FFT on the output G(m) of the noise reducer 20.

Figure 2:
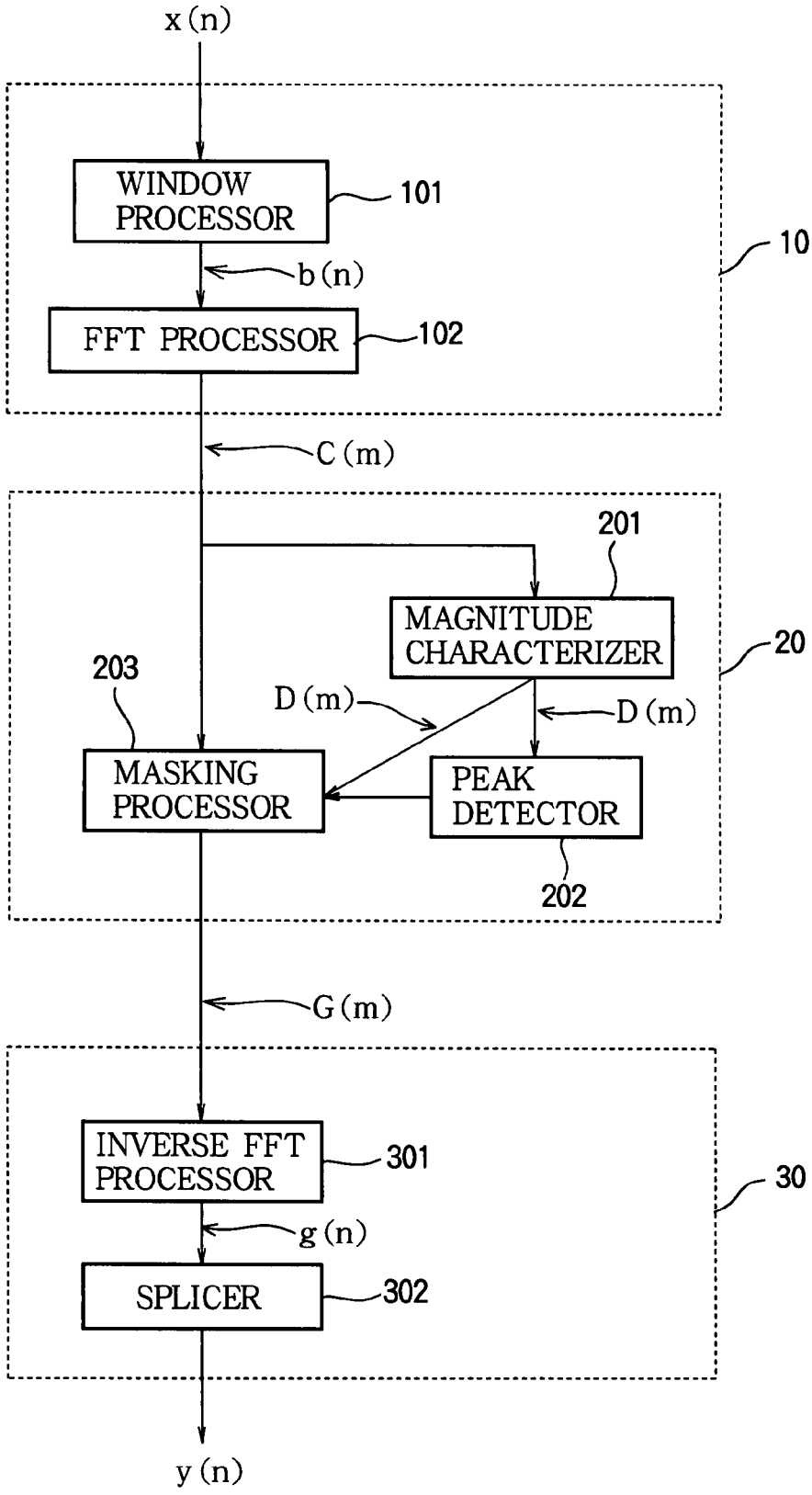
FIG. 2 is a more detailed block diagram showing the internal structure of the noise suppressor in FIG. 1.

The analyzer 10 comprises a window processor 101 and a fast Fourier transform (FFT) processor 102 as shown in FIG. 2.

The notation x(n) in FIGS. 1 and 2 represents the nth data sample in the digital speech signal received by the analyzer 10. The digital speech signal x(n) is obtained by, for example, sampling an analog speech signal from a microphone or other speech input device at periodic intervals and converting the samples to digital values. The analyzer 10 processes N samples at a time, the N samples being referred to as a frame. A typical value of N is 512. When the analyzer 10 completes the analysis of one frame, the last N/2 speech signals x(n) are shifted forward, the next N/2 samples are input and concatenated behind them to generate a new frame of N consecutive samples, and the new frame is analyzed; that is, the frame shifts forward repeatedly in overlapping steps of N/2 samples.

The input digital speech signal is not limited to a signal picked up by a microphone and converted from analog to digital form. The signal may be read from a memory, or transmitted from another device.

The window processor 101 applies a window function to the N consecutive samples x(n) to improve the precision of the analysis. The output b(n) of the window processor 101 is obtained by multiplication by a window function w(n) as in equation (1). Various window functions are applicable; for example, the Hamming window given by equation (2) may be applied. The windowing process is executed in relation to the frame splicing process carried out in the output generator 30 as described later.

$$b(n) = w(n) \cdot x(n). \tag{1}$$

$$\text{where } w(n) = 0.54 - 0.46 \cdot \cos\left(\frac{2n\pi}{N}\right) \tag{2}$$

Although the use of a window function is preferred, it is not strictly necessary. In some situations the window processor 101 should be omitted, as noted below.

The FFT processor 102 performs an N-point FFT on the output b(n) of the window processor 101. The spectrum C(m) obtained in the FFT processor 102 is accordingly the result of the discrete Fourier transform (DFT) given by equation (3), the integer m in which is known as the frequency number.

$$C(m) = \frac{1}{N}\sum_{n=0}^{N-1} b(n) \times e^{-2\pi j \frac{mn}{N}} \text{ where } m \text{ is } 0 \text{ to } N-1 \tag{3}$$

The invention is not limited to use of the FFT; other methods of analyzing the signal into a frequency spectrum may be applied. Furthermore, if the noise suppressor 1 forms part of a device that already employs a frequency analyzer for another purpose, that frequency analyzer may be used as a component element of the noise suppressor 1, instead of providing a separate analyzer 10. Such a configuration is possible, for example, when the noise suppressor 1 is used in an Internet protocol (IP) telephone. An IP telephone inserts encoded FFT output into the IP packet payload; the FFT output prior to encoding may be used as the output of the analyzer 10 described above.

The noise reducer 20 has a magnitude characterizer 201, a peak detector 202, and a masking processor 203 as shown in FIG. 2.

The magnitude characterizer 201 calculates a magnitude curve or amplitude characteristic of the frequency spectrum C(m) received from the FFT processor 102. As the frequency spectrum C(m) consists of complex values, the magnitude characterizer 201 takes their absolute values, and then performs a logarithmic conversion on the absolute values to obtain the amplitude characteristic D(m) as in equation (4). The logarithmic conversion provides perceptual linearity.

$$D(m)=\log_{10}\|C(m)\| \text{ (where } \|\bullet\| \text{ denotes absolute value)} \tag{4}$$

As the spectrum C(m) has the property C(m)=C*(N−m) (where 1≦m≦N/2−1, and C*(N−m) is the complex conjugate value of C(N−m)), it is sufficient to perform the processes in the noise reducer 20 on values of m in the range of 0≦m≦N/2.

The peak detector 202 detects the positions of peaks in the amplitude characteristic D(m). The peak detector 202 finds peak points $m_p$ at which the value of the amplitude characteristic D(m) reaches a local maximum.

To reduce the effects of noise and to emphasize the peaks (local maxima) in the amplitude characteristic D(m), a local comparison function E(k) approximating the average shape of a typical speech signal spectrum around a peak position is used. The degree of dissimilarity F(m) between the amplitude characteristic D(m) and the local comparison function E(k) is calculated according to equation (5), and any position at which the degree of dissimilarity F(m) attains a local minimum value below a predetermined threshold level is taken as a peak point $m_p$. Roughly speaking, the peak detector 202 detects peaks with shapes that strongly resemble a typical speech peak. The local comparison function E(m) is prestored in the peak detector 202. The symbols −M1 and M2 in equation (5) represent the beginning and end of the interval over which the local comparison function E(k) is defined.

$$F(m) = \sum_{k=-M1}^{M2} ((D(m+k) - E(k)) - (D(m) - E(0)))^2 \tag{5}$$

The masking processor 203 performs the following masking process on the detected peak points $m_p$, starting with the peak point $m_m$ having the largest magnitude $D(m_m)$.

A masking function $M(s, m_m, D(m_m))$ created on the basis of known perceptual masking characteristics is prestored in a table in the masking processor 203 (see FIG. 8 below). The masking processor 203 performs the masking process by replacing values in the output C(m) of the FFT processor 102 with zero at points s (0≦s≦N/2) at which the spectral magnitude D(s) and masking function $M(s, m_m, D(m_m))$ satisfy the relationship in inequality (6). The masking processor 203 performs this masking process for other peak points $m_p$ as well.

$$D(m_m)-D(s)>M(s,m_m,D(m_m)) \tag{6}$$

This masking process yields the values of the noise-suppressed spectrum G(m) in the range of 0≦m≦N/2. The values of G(m) in the range of N/2+1≦m≦N−1 are obtained from the relationship G(m)=G*(N−m). The complete noise-suppressed spectrum G(m) thus obtained is received by the output generator 30.

The output generator 30 has an inverse FFT processor 301 and a splicer 302 as shown in FIG. 2.

The inverse FFT processor 301 performs an inverse FFT on the noise-suppressed spectrum G(m) to obtain the noise-suppressed signal g(n). If, in place of the FFT, the analyzer 10 uses some other type of frequency analysis process, the inverse FFT processor 301 uses the corresponding inverse process.

The splicer 302 adds the values of the first N/2 data points in the noise-suppressed signal g(n) of the current frame to the values of the last N/2 data points in the noise-suppressed signal g'(n) of the immediately preceding frame to obtain the output speech signal y(n), as in equation (7).

$$y(n)=g(n)+g'(n+N/2) \tag{7}$$

In the above process, the data are shifted so that half of the data (N/2 samples) in successive frames overlap; this is a well-known method of smoothly splicing waveforms. The time available to the analyzer 10, noise reducer 20 and output generator 30 in which to process one frame as described above is NT/2, where T is the sampling period of the speech signal. The sampling period T is generally in the range from 31.25 microseconds to 125 microseconds, so if N is 512, then NT/2 is in the range from 8 to 32 milliseconds.

Depending on the use of the noise suppressor, it may be possible to omit the output generator 30 or to use the output generator of another device. When the noise suppressor is used in a speech recognition device, for example, the output generator 30 may be omitted by using the values of the noise-suppressed spectrum G(m) as recognition features. When the noise suppressor is used in an IP telephone set, the output generator already present in the IP telephone set may be used to perform the above processes.

The operation (noise suppression method) of the noise suppressor 1 having the structure described above will now be explained with reference to FIGS. 3 to 8.

As described above, the window processor 101 performs a windowing process on the N consecutive data samples x(n) received by the analyzer 10, the FFT processor 102 performs an N-point FFT on the windowed data b(n) output from the window processor 101, and the noise reducer 20 processes the resulting frequency spectrum C(m) in the range $0 \leqq m \leqq N/2$, taking advantage of the relationship $C(m)=C^*(N-m)$ to omit processing for values of m greater than N/2.

Figure 3:
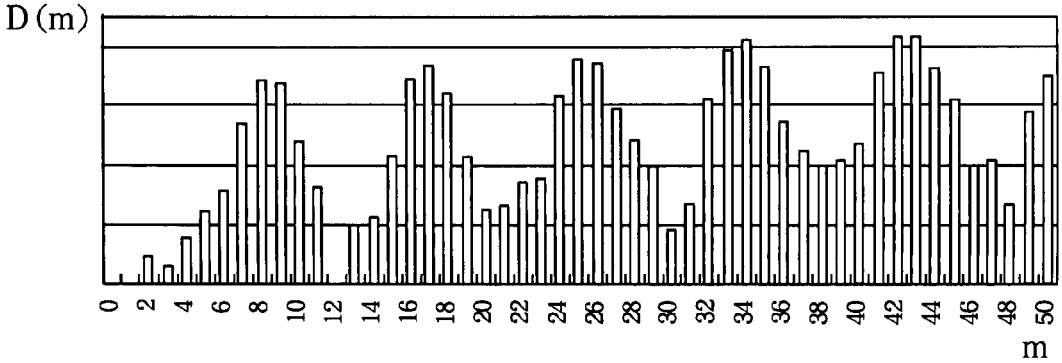
FIGS. 3, 4, 5, 6, and 7 are graphs illustrating signals output by or related to the blocks in FIG. 2.

The magnitude characterizer 201 in the noise reducer 20 calculates the magnitude curve or amplitude characteristic of the spectrum C(m). FIG. 3 is a graph showing part of an exemplary amplitude characteristic D(m) output by the magnitude characterizer 201. The complete amplitude characteristic D(m) generally includes from about thirty to one hundred peak points.

Figure 4:
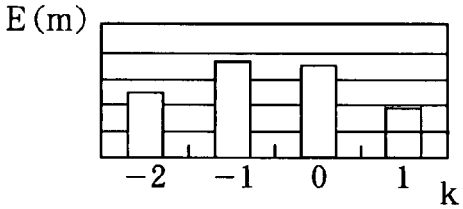
Figure 5:
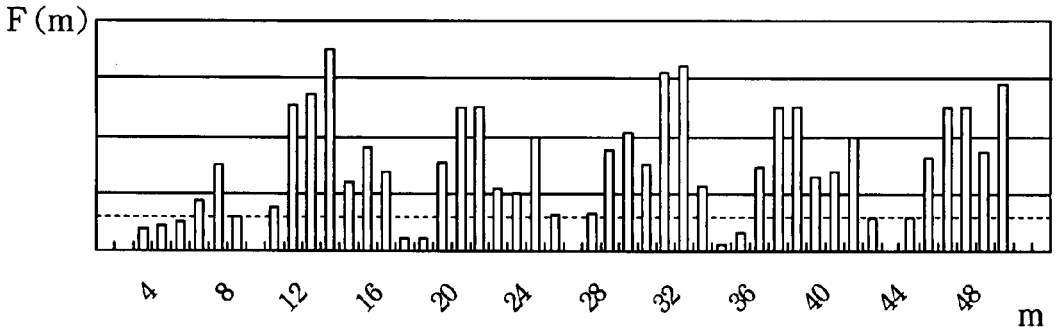
Figure 6:
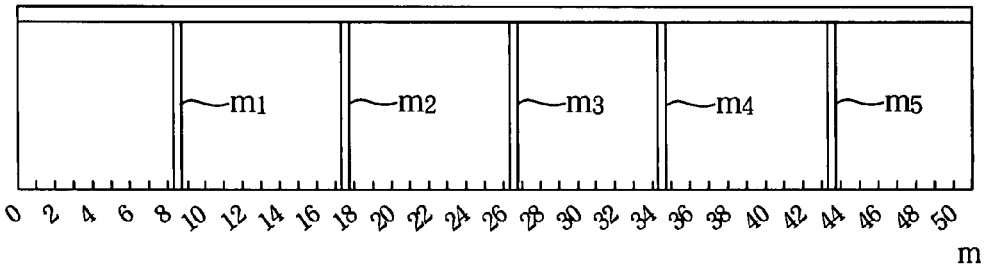

To detect peaks in the amplitude characteristic D(m) the peak detector 202 may use, for example, the local comparison function E(k) shown in FIG. 4. A sliding comparison between this local comparison function and four-point segments of the amplitude characteristic D(m) in FIG. 3 yields dissimilarity values F(m) similar to the ones shown in FIG. 5, calculated according to equation (5) above. Local minima of F(m) that are lower than a predetermined threshold are taken as peak points $m_p$. If the threshold is set at the level of the dotted line in FIG. 5, peaks are detected at the points $m_1$, $m_2$, . . . shown in FIG. 6.

From among the peak points $m_p$, the masking processor 203 determines the peak point $m_m$ having the largest amplitude $D(m_m)$, reads the prestored values $M(s, m_m, D(m_m))$ of the masking function corresponding to peak position $m_m$ and amplitude $D(m_m)$ from the table, and tests the condition on the amplitude D(s) given by inequality (6) above for values of s in the range of $0 \leqq s \leqq N/2$. When this condition is satisfied, the corresponding frequency spectrum value C(s) is replaced with zero, thereby removing the corresponding frequency component from the spectrum. The masking function is defined so that the masking process removes frequency components that are significantly smaller than the peak amplitude, where the criteria for being significantly smaller become more stringent with increasing distance from the peak.

Figure 7:
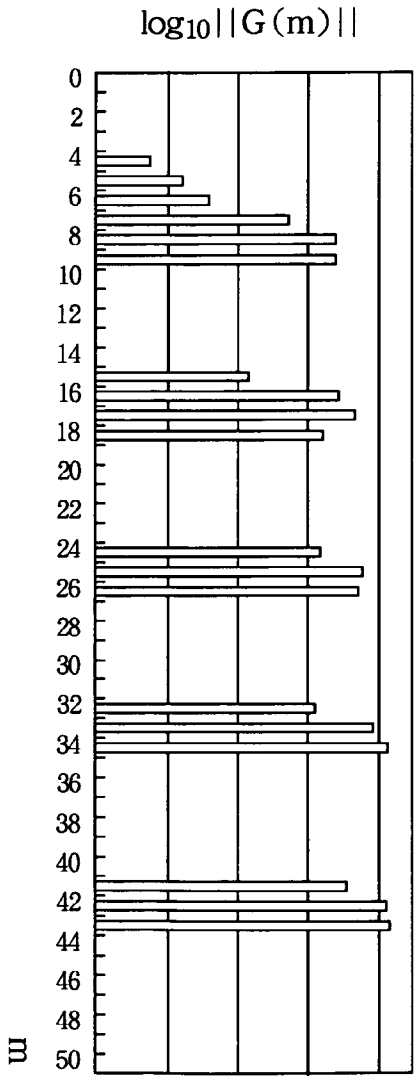

After completing this masking process for the peak point $m_m$ with the largest amplitude, the masking processor 203 further modifies the frequency spectrum by performing a similar masking process for the peak position $m_p$ with the next largest amplitude, and proceeds in this way through all the detected peak points in their order of magnitude. When a frequency component is removed, if it was located at one of the peak positions $m_p$, that position may be discarded from the list of peak positions, to avoid unnecessary masking processing for peaks that have themselves already been masked. FIG. 7 shows the amplitude characteristic of the noise-suppressed frequency spectrum G(m) produced as a final result of the masking process.

Figure 8:
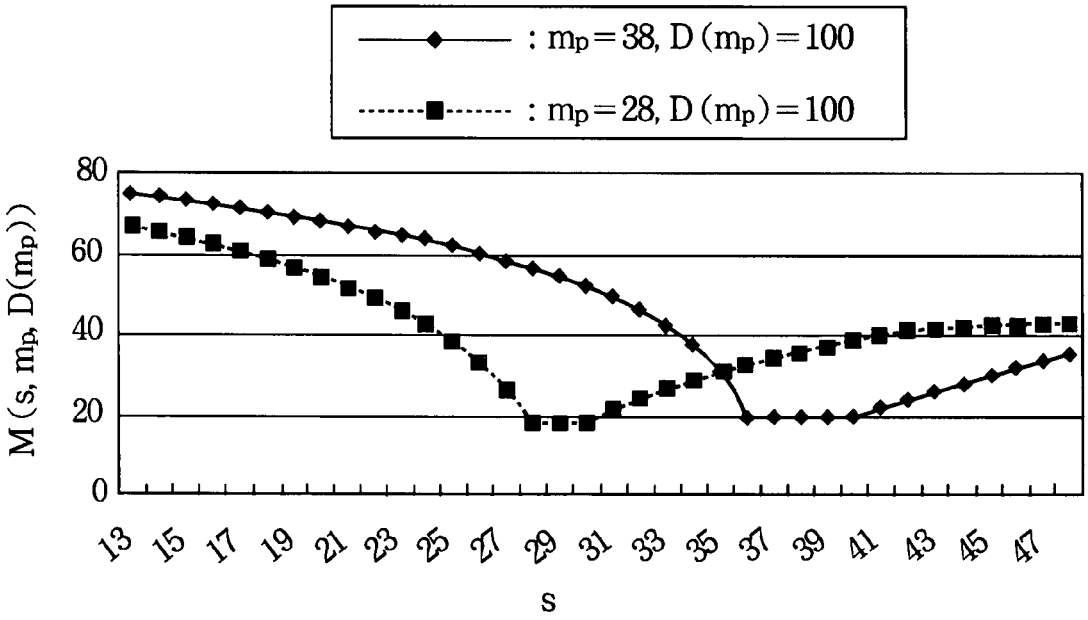
FIG. 8 is a graph showing exemplary masking curves.

FIG. 8 shows part of the prestored data for an exemplary masking functions $M(s, m_p, D(m_p))$. The solid curve (connecting the black rhomboids) represents the masking function M(s, 38, 100) for a peak with a frequency value of 38 and an amplitude value of 100; the dotted curve (connecting the black squares) represents the masking function M(s, 28, 100) for a peak with a frequency value of 28 and an amplitude value of 100. A frequency component is removed if its amplitude is less than the peak amplitude by at least the value on the relevant curve. FIGS. 7 and 8 show that high frequencies and low frequencies have different masking effects.

The masking function is preferably designed so that masking increases with increasing frequency, as illustrated in FIG. 7. Around each peak in FIG. 7, there is more masking in the high-frequency direction than in the low-frequency direction. In addition, frequency components around the highest-frequency peak in FIG. 7 have been removed unless they are closely associated with the peak in terms of both frequency and magnitude, while at the lowest-frequency peak, these criteria are more relaxed.

As can be appreciated from FIG. 7, the present embodiment is capable of removing large amounts of noise, especially at higher frequencies, while still leaving sufficient frequency components to characterize the input speech signal in all frequency ranges. The remaining frequency components tend to have a high signal-to-noise ratio. Any noise present at these frequencies is effectively masked by the speech signal and the presence of the noise will not be noticed. Although some speech frequencies are also removed, they are close enough to peak speech frequencies that their absence can be dealt with by the well-developed continuous frequency processing capabilities of the human acoustic perception system. The present invention takes advantage of these capabilities to produce an output speech signal that sounds clear and natural but is largely free of random noise.

Incidentally, the amplitude characteristic in FIG. 7 is shown only for explanatory purposes; the actual output of the masking processor 203 is the noise-suppressed frequency spectrum G(m), not its amplitude characteristic. The noise-suppressed spectrum G(m) is obtained as described above in the range of $0 \leqq m \leqq N-1$. The noise-suppressed spectrum G(m) in the range of $N/2+1 \leqq m \leqq N-1$ is obtained from the relation $G(m)=G^*(N-m)$.

The inverse FFT processor 301 in the output generator 30 performs an N-point inverse FFT to convert the noise-suppressed spectrum G(m) to a noise-suppressed signal g(n), and the splicer 302 splices the noise-suppressed signals g(n) of successive frames to obtain the output speech signal y(n).

Like conventional spectral subtraction, the embodiment described above operates in the frequency domain, so it does not require extensive time-domain processing such as autocorrelation computation, and it does not require two microphones or the processing of two input signals. Unlike conventional spectral subtraction, the embodiment described above removes irregular noise at even high noise levels, and does not require the detection of speech-free intervals or the determination of a separate noise spectrum. Accordingly, the above embodiment provides an effective way to suppress a wide variety of irregular noise without requiring extra hardware or extensive signal processing.

Some exemplary variations of the above embodiment will now be described.

The overlapping of frames in the above embodiment is not essential; each successive frame may consist of an entirely new set of samples. Noise reduction can then be carried out with a processor of lower processing power than required in the embodiment above, or by a processor that must devote more of its power to other processes. When the frames do not overlap, it is also preferable not to execute the windowing process.

The computation carried out in the magnitude characterizer 201 may be simplified in two ways. One way is to omit the logarithmic conversion and to calculate the amplitude characteristic D(m) using equation (8) below. A further way is to omit the square-root operation required in the absolute-value calculation and to calculate the amplitude characteristic D(m) using equation (9). Either of these simplifications can produce results similar to those obtained in the embodiment above, provided the masking function $M(s, m_m, D(m_m))$ is altered accordingly.

$$D(m)=\|C(m)\| \text{ (where } \|\bullet\| \text{ denotes absolute value)} \tag{8}$$

$$D(m)=\|C(m)\|^2 \text{ (where } \|\bullet\| \text{ denotes absolute value)} \tag{9}$$

The peak detection process in the peak detector 202 may be simplified by averaging the amplitude characteristic D(m) over intervals from m−K to m+K (where K is a positive integer).

The masking function $M(s, m_m, D(m_m))$ may be simplified to the form in equation (10), which assigns a predetermined constant value H to positions s within a fixed distance P of the peak position $m_p$ and assigns the greatest expressible positive value to more distant positions. The masking value is accordingly constant within a local range including the peak position $m_p$, and no components outside that local range are removed, because no component can have a magnitude exceeding the greatest expressible positive value. If the constant P is set to the average distance between peak points $m_p$, then on the average, the masking function given by equation (10) removes frequency components with amplitudes that are attenuated by more than H with respect to the amplitude of the nearest peak point $m_p$.

$$M(s, m_p, D(m_p)) = \begin{cases} H & \text{if } |s-m_p| \le P \\ \text{greatest positive value} & \text{if } |s-m_p| > P \end{cases} \tag{10}$$

In another possible simplification, the masking function has the form $M(s, m_p, D(m_p))=M_1(s, m_p)+M_2(D(m_p))$, so that it is the sum of a first function $M_1$ of the peak position $m_p$ and frequency number s and a second function $M_2$ of the peak magnitude $D(m_p)$. With this type of masking function it only necessary to store a single curve of the type shown in FIG. 8 for each peak position $m_p$, and adjust these curves vertically according to the peak magnitude value of $D(m_p)$.

Instead of completely removing masked frequency components, the masking process may only attenuate them. For example, the complex values C(m) of masked frequency components may be multiplied by a positive real number less than unity.

The noise suppressor according to the present invention may be used in combination with other noise suppressors. A sound source separator that uses two microphones to separate the speech of a plurality of speakers by independent component analysis (ICA) may be provided upstream of the inventive noise suppressor, and the inventive noise suppressor may be used to remove residual noise from each separated speech signal.

Those skilled in the art will recognize that further variations are possible within the scope of the invention, which is defined in the appended claims.

What is claimed is:

1. A noise suppressor for removing noise components from a speech signal, comprising:

a peak detector for detecting a peak position in a spectrum of the speech signal; and a masking processor for reducing components of the spectrum as a function of the peak position, thereby generating a noise-suppressed spectrum;

wherein for each component of the spectrum, the masking processor obtains a masking value as a function of the peak position, a magnitude of the spectrum at the peak position, and a frequency number, and reduces the component if the component has a magnitude satisfying a predetermined condition with respect to the masking value, and wherein the predetermined condition is that the magnitude of the component is less than the magnitude of the spectrum at the peak position by at least the masking value, the masking value being a sum of a first function of the peak position and the frequency number and a second function of the magnitude of the spectrum at the peak position.

2. The noise suppressor of claim 1, further comprising a frequency analyzer for receiving the speech signal and obtaining the spectrum of the speech signal.

3. The noise suppressor of claim 1, further comprising a signal generating processor for converting the noise-suppressed spectrum to an output speech signal.

4. The noise suppressor of claim 1, wherein the peak detector detects the peak position by making a sliding comparison of the spectrum with a local comparison function.

5. The noise suppressor of claim 4, wherein the peak detector calculates a dissimilarity value for different positions in the spectrum, the dissimilarity value indicating a degree of dissimilarity between the local comparison function and a local part of the spectrum, and detects the peak position as a position at which the dissimilarity value attains a local minimum value lower than a predetermined threshold.

6. The noise suppressor of claim 1, wherein the masking processor reduces said components to zero.

7. The noise suppressor of claim 1, wherein the masking processor attenuates said components.

8. A method of removing noise components from a speech signal, comprising:

detecting a peak position in a spectrum of the speech signal; and reducing components of the spectrum as a function of the peak position, thereby generating a noise-suppressed spectrum, comprising, for each component of the spectrum:

obtaining a masking value as a function of the peak position, a magnitude of the spectrum at the peak position, and a position of the component of the spectrum; and reducing the component if the component has a magnitude satisfying a predetermined condition with respect to the masking value;

wherein the predetermined condition is that the magnitude of the component is less than the magnitude of the spectrum at the peak position by at least the masking value; and wherein the masking value is a sum of a first function of the peak position and the position of the component of the spectrum and a second function of the magnitude of the spectrum at the peak position.

9. The method of claim 8, further comprising receiving the speech signal and obtaining the spectrum of the speech signal.

10. The method of claim 8, further comprising converting the noise-suppressed spectrum to an output speech signal.

11. The method of claim 8, wherein detecting the peak position further comprises making a sliding comparison of the spectrum with a local comparison function.

* * * * *